US011084322B2

(12) United States Patent
Arasawa

(10) Patent No.: US 11,084,322 B2
(45) Date of Patent: Aug. 10, 2021

(54) RESEALABLE AIRTIGHT CONTAINER SYSTEM FOR USING AND STORING PAINT

(71) Applicant: Alexsandro Arasawa, Kailua, HI (US)

(72) Inventor: Alexsandro Arasawa, Kailua, HI (US)

( * ) Notice: Subject to any disclaimer, the term of this patent is extended or adjusted under 35 U.S.C. 154(b) by 46 days.

(21) Appl. No.: 16/441,887

(22) Filed: Jun. 14, 2019

(65) Prior Publication Data

US 2019/0381823 A1 Dec. 19, 2019

Related U.S. Application Data

(60) Provisional application No. 62/685,131, filed on Jun. 14, 2018.

(51) Int. Cl.

| | |
|---|---|
| ***B44D 3/12*** | (2006.01) |
| ***B65D 25/28*** | (2006.01) |
| ***B65D 25/24*** | (2006.01) |
| ***B65D 25/08*** | (2006.01) |
| ***B65D 21/02*** | (2006.01) |
| ***B65D 53/02*** | (2006.01) |

(52) U.S. Cl.

CPC ..... *B44D 3/12* (2013.01); *B65D 21/0223* (2013.01); *B65D 25/08* (2013.01); *B65D 25/24* (2013.01); *B65D 25/2888* (2013.01); *B65D 53/02* (2013.01); *B44D 3/122* (2013.01); *B44D 3/128* (2013.01)

(58) Field of Classification Search

CPC ..... B44D 3/12; B44D 3/122; B44D 3/128; B65D 21/0223; B65D 25/08; B65D 25/24; B65D 25/2888; B65D 3/02

USPC ..... 220/528, 4.26

See application file for complete search history.

(56) References Cited

U.S. PATENT DOCUMENTS

| | | | | |
|---|---|---|---|---|
| 2,844,276 | A | 7/1958 | Dimmock | |
| 2,939,603 | A * | 6/1960 | Young | B65D 21/0223 220/4.21 |
| 3,485,408 | A * | 12/1969 | Benesch | B65F 1/12 220/4.26 |
| 3,944,115 | A | 3/1976 | Moonam et al. | |
| 4,893,723 | A | 1/1990 | Seabolt | |
| 6,003,706 | A * | 12/1999 | Rosen | B65D 81/3816 220/4.26 |
| 6,126,048 | A | 10/2000 | Bublitz | |
| 6,983,869 | B1 * | 1/2006 | Stevens | B44D 3/128 220/701 |
| 8,123,066 | B2 | 2/2012 | Chafe et al. | |
| 8,328,013 | B2 | 12/2012 | Stevens | |
| 8,800,795 | B2 * | 8/2014 | Hwang | A45C 7/0031 220/4.03 |

(Continued)

*Primary Examiner* — J. Gregory Pickett
*Assistant Examiner* — Niki M Eloshway
(74) *Attorney, Agent, or Firm* — Joan K. Lawrence

(57) ABSTRACT

A resealable airtight container system is provided for holding and storing paint that preserves and maintains the paint in a clean, high quality condition for current and subsequent use. Different embodiments of the system include a non-cylindrical container component, a removable container edge-protecting lip component that engages an upper edge of the non-cylindrical container, and a sealing lid component that provides an airtight seal to cover and seal the container. The lip component may be stored in the lid component when not in use. In one embodiment, the system provides a non-cylindrical container that may function both as a painting tool carrier and as a resealable paint container.

16 Claims, 5 Drawing Sheets

(56) References Cited

U.S. PATENT DOCUMENTS

| | | | | |
|---|---|---|---|---|
| 9,185,996 | B2 * | 11/2015 | Brundick | A47F 1/08 |
| 2004/0262306 | A1 * | 12/2004 | Smith | B65D 21/0228 220/4.26 |
| 2006/0266747 | A1 * | 11/2006 | Stolzman | B65D 19/18 220/4.26 |
| 2006/0273092 | A1 | 12/2006 | Nottingham et al. | |
| 2009/0032538 | A1 * | 2/2009 | Lee | B44D 3/122 220/525 |
| 2009/0038271 | A1 | 2/2009 | Nottingham et al. | |
| 2010/0044389 | A1 * | 2/2010 | Logue | B65D 43/0212 220/752 |
| 2017/0233160 | A1 | 8/2017 | Hudson et al. | |
| 2018/0161975 | A1 * | 6/2018 | Brunner | B65D 21/0223 |
| 2018/0257424 | A1 | 9/2018 | Robertson et al. | |
| 2019/0100370 | A1 * | 4/2019 | Kieling | B65D 43/162 |
| 2019/0177039 | A1 * | 6/2019 | Scholl | B65D 1/18 |

* cited by examiner

RESEALABLE AIRTIGHT CONTAINER SYSTEM FOR USING AND STORING PAINT

PRIORITY CLAIM

This application claims priority from U.S. Provisional Patent Application No. 62/685,131, filed 14 Jun. 2018, the disclosure of which is fully incorporated herein by reference.

TECHNICAL FIELD

The present invention relates generally to resealable containers for holding liquids and specifically to a resealable airtight container system for paint and similar liquids that holds the paint or similar liquid during use and stores and preserves the paint or similar liquid for subsequent use.

BACKGROUND OF THE INVENTION

Painters of all levels of experience, from painting contractors to do-it-yourself project painters, have experienced the frustrations and challenges of opening a can of paint, using a portion of the quantity of paint in the can, and then trying to reseal the can with the lid provided to save the remaining paint to finish the job later or to use for another job. Most commercially available paint cans have a lid that fits into a circumferential recess in a rim at the top of the paint can. Paint easily flows into the circumferential recess when these cans are opened and the paint is stirred and/or poured into another container. Paint may also flow into the circumferential recess as a painter's brush is dipped into the paint and then wiped against the rim. After a paint can has been opened and the paint inside has been stirred and used, it is difficult and time-consuming to clean accumulated paint out of the circumferential recess.

Even a small amount of paint that remains within the circumferential recess may prevent the formation of an airtight seal when the originally provided lid is put back on the paint can. If the paint can is not sealed with an airtight seal, the paint remaining inside may evaporate, deteriorate, or become otherwise unusable, for example as a result of impurities entering the paint. If usable, the saved paint may not be of a quality that will produce as high quality a paint job as desired. When a painting contractor is not able to preserve unused paint for subsequent reuse during the course of a job, additional paint must be purchased, increasing the cost of the job. This could add significantly to a job's costs, depending on the size of the job and the amount of paint that must be purchased to replace that which was not usable.

The art has proposed solutions that attempt to solve some of the foregoing challenges. Proposed solutions are directed primarily to adapting or providing lids for commercially available paint cans to improve sealing after the cans have been opened. For example, one available lid is made of a material that stretches and is intended to fit most gallon size paint cans. While some of the proposed lids may solve some issues related to paint overflow, they may not seal paint cans as effectively as required to maintain saved paint in a high quality reusable condition. As a result, the paint stored in cans with such lids, while potentially reusable, might not produce a high quality paint job. None of the available solutions provides a reliable airtight seal in a container system for using and storing paint that preserves the paint in a clean, high quality condition for future use.

The configuration of currently available paint cans and containers may also contribute to an accumulation of paint in or around the lid and the prevention of an airtight seal.

Paint cans and containers are available in a range of sizes that typically ranges from a single quart, or less, to at least five gallons. All of these cans and containers presently have the same cylindrical shape. The circumferential recess has a smaller diameter than the can or container diameter, and, as noted above, excess paint wiped off the brush may accumulate in the circumferential recess. The excess paint may also drip back into the can or container, taking with it any impurities present in or around the circumferential recess where the brush is wiped into the paint remaining in the can or container. The art has suggested containers for paint and other liquids that are not cylindrical. The available non-cylindrical containers intended for paint hold a quantity of paint temporarily for use during a painting job and are not designed or intended to be sealed to provide a clean system that preserves the paint for future use.

There is a need, therefore, for a resealable airtight container system for holding paint during use and then for storing the paint for subsequent reuse that maintains the paint in a clean, high quality condition.

SUMMARY OF THE INVENTION

It is a primary object of the present invention, therefore, to provide a resealable airtight container system for holding and storing paint that maintains the paint in a clean, high quality condition during initial use and for subsequent reuse.

It is another object of the present invention to provide a resealable container for paint and similar liquids that has a non-cylindrical configuration.

It is an additional object of the present invention to provide a resealable container for paint and similar liquids with seal elements that ensure creation of an airtight seal after the container has been opened and then resealed to preserve and store paint or similar liquid remaining in the container.

It is a further object of the present invention to provide an integral painting tool carrier and resealable paint container with airtight seal-creating elements that permits use of the integral carrier and container to transport painting tools and equipment, to hold paint during a painting job, and to store and preserve paint in a clean airtight condition.

In accordance with the aforesaid objects, embodiments of a resealable airtight container system for storing paint that preserves and maintains the paint in a clean, high quality condition for subsequent reuse are provided. In one embodiment, the system includes a container with a non-cylindrical shape and a multiple element sealing portion shaped to engage an upper edge of the container, to cover a top opening of the container, and to seal the container. In another embodiment, the resealable airtight container system includes a container with the shape of a trapezoidal solid with a handle that facilitates use of multiple sizes of brushes and painting rollers up to about 6 inches in length. A lip element may be configured to engage the container edge, and a lid member may be configured to engage both the lip element and the container edge. An additional embodiment of the system provides a non-cylindrical container that may function as an integral painting tool carrier and resealable paint container. When the system is not used as a painting tool carrier, it may be used as a paint container, and a sealing portion may be provided to engage, cover, and seal the non-cylindrical paint container to store and preserve paint in a clean, high quality condition so that the paint may be used at a later time.

Other objects and advantages will be apparent from the following description, claims, and drawings.

DESCRIPTION OF THE INVENTION

The resealable airtight container system of the present invention provides a versatile container system for holding and storing paint and similar liquids, and its design may allow a professional painter or other user to complete a job or a painting project more quickly and with less paint than may be possible with available paint containers and resealable lids. The system of the present invention may be used to hold paint during a job and to facilitate access to the paint by different paint applicators. When not all of the paint in the container has been used, for example, if the painting process must be interrupted or when there is paint remaining after a job is completed, the container may be securely resealed in a manner discussed below that preserves the paint in a clean, high quality condition for later use. If all of the paint in the container is used up, the resealable airtight container system may be easily dissembled for cleaning and reuse.

Figure 1:
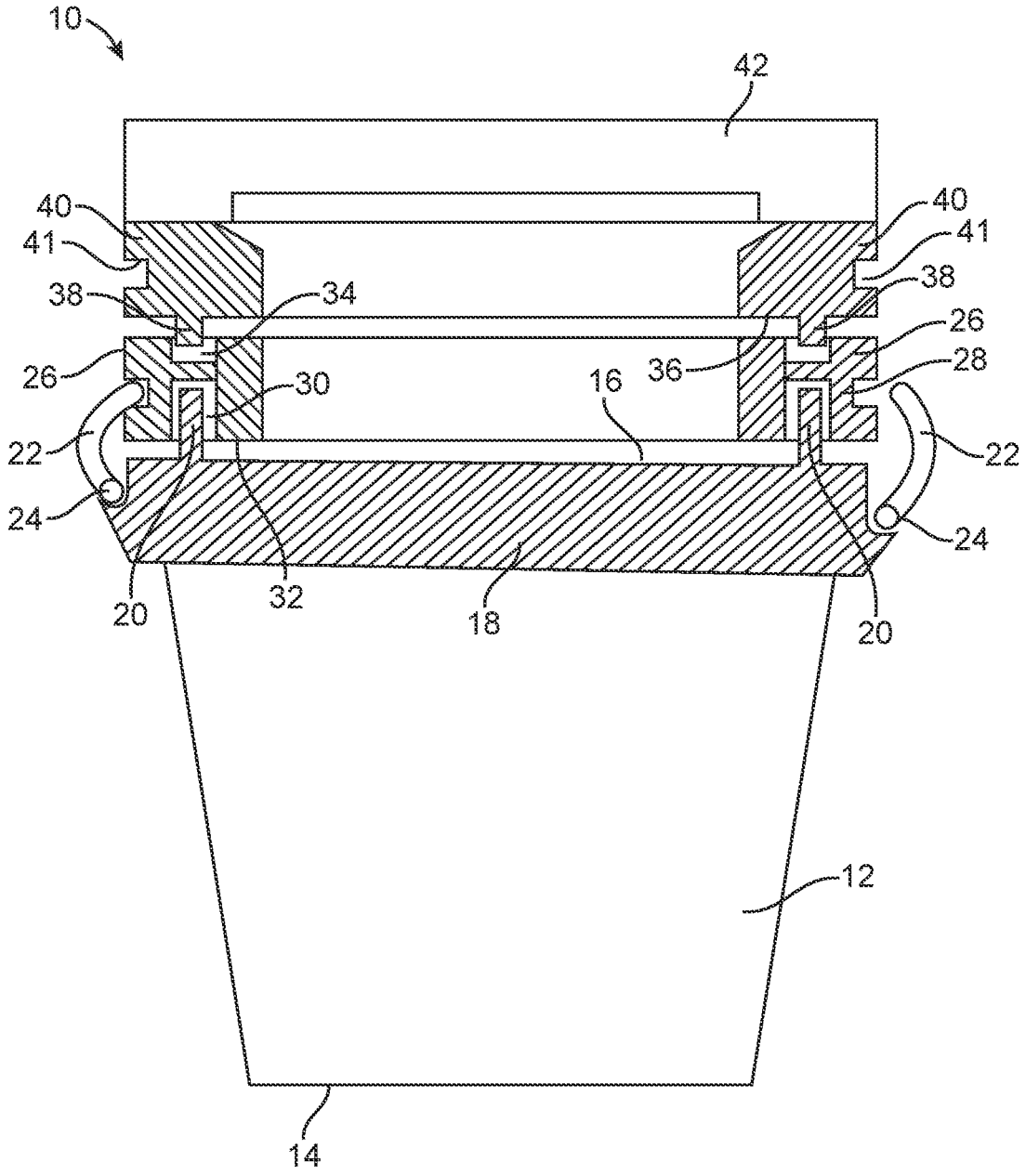
FIG. 1 is a diagrammatic illustration of one embodiment of the resealable airtight container system of the present invention from a front view.
Figure 2:
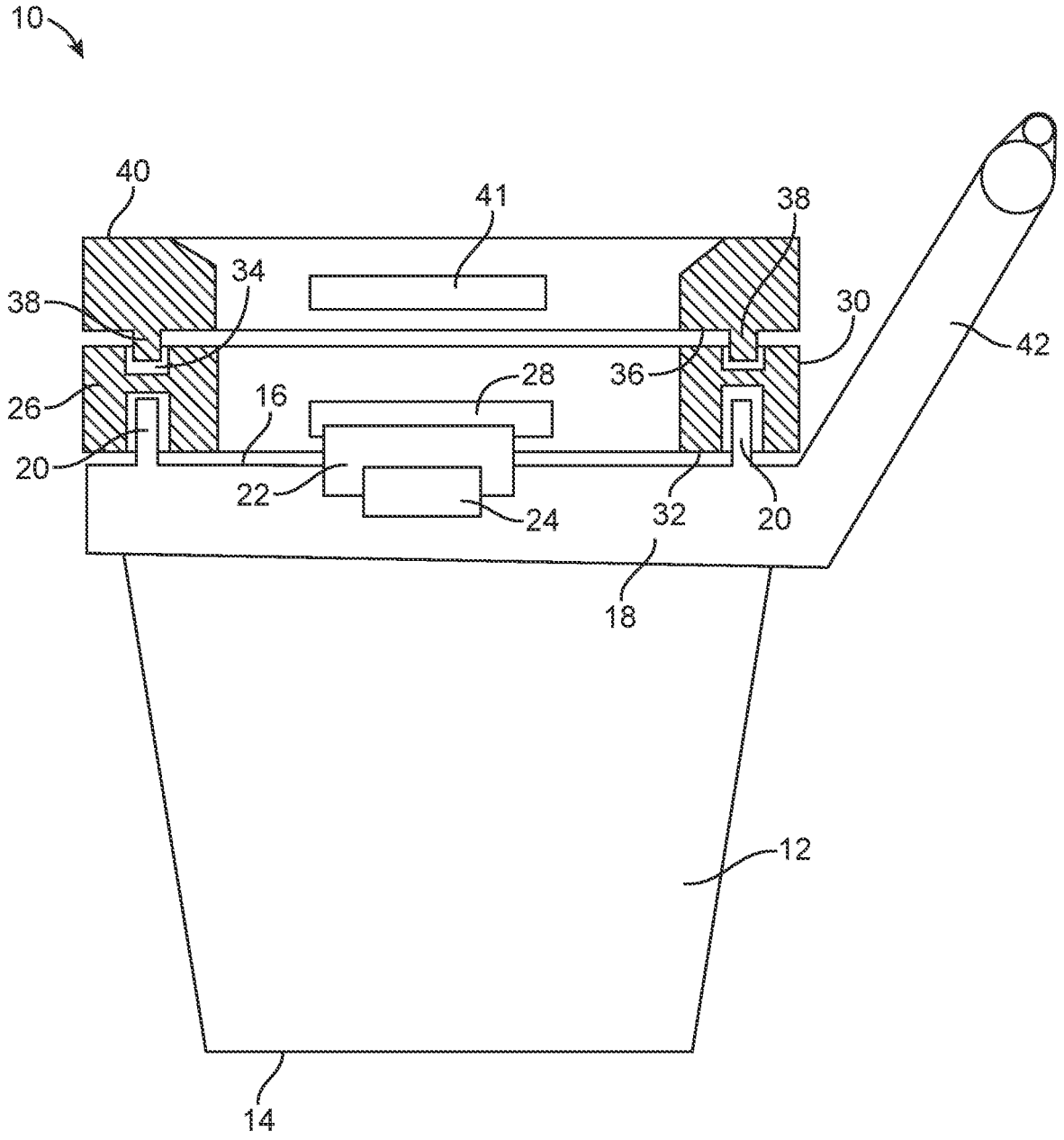
FIG. 2 is a diagrammatic illustration of the resealable airtight container system of the FIG. 1 turned about 90 degrees from the front view shown in FIG. 1.

Referring to the drawings, which may not be drawn to scale, three different embodiments of the resealable airtight container system of the present invention are shown. FIGS. 1 and 2 show a first embodiment of the resealable airtight container system of the present invention from two different views. The resealable airtight container system 10 includes multiple components that are structurally and functionally arranged to provide a holder for a quantity of paint or a similar liquid and to seal the holder with an airtight seal. A non-cylindrical holder or paint container 12, which may also be referred to as a paint bucket, may have the shape of a truncated cone and resemble a flowerpot, with a bottom surface 14 and a circumferential upper edge 16 that defines a circular opening (not shown). The angled interior of the container 12 may provide a surface for wiping excess paint off a brush. The container 12 may be sized to hold different quantities of paint or a similar liquid. Professional painters use most frequently and are most familiar with the one gallon and five gallon containers in which most paints are currently sold, and it is contemplated that the container 12 of the present invention may be made to hold these volumes of paint and may be sized accordingly. The present system may also be constructed to hold any desired paint quantity.

A rim element 18 may be formed integrally with the container 12 or may be formed separately and then attached to the container 12 to form the upper edge 16. The rim element 18 may have an overall rectangular shape with a central opening that may be rectangular or that may have a circular shape or another shape. The rim element 18 may be formed with an edge projection 20 that extends outwardly of the upper edge 16 completely or partially around the perimeter or the circumference of the rim element. The rim element 18 may also include clamps 22 that may be spaced on opposite sides of the rim element and/or in other locations about the rim element as well. The rim element 18 may be shaped to include pivot locations 24 that provide pivot attachments for the clamps 22. The pivotal attachment of clamps 22 allows the clamps 22 to be pivoted into and out of engagement with a detachable edge cover 26. One of the clamps 22 is shown in an engaged position within an engagement recess 28 in the edge cover 26, and the opposite clamp 22 is shown in an unengaged or released position.

The edge projection 20 on the rim element 18 may be received within a corresponding receptacle 30 in a rim element-contacting surface 32 of the edge cover 26. The edge cover 26 may include a recess 34 in an outward surface 36 to receive a lid projection 38 on a lid 40. The edge projection 20 and the lid projection 38 may have different configurations than those shown and may be sized with the corresponding receptacle 30 and recess 34 to produce a secure press fit when the edge cover 26 is clamped into engagement with the rim element 18 and when the lid 40 is used to cover the entire assembly.

The clamps 22 may also be used to attach the lid 40 to the rim element 18 when the edge cover 26 has been removed. Ensuring a tight fit between the lid 40 and the rim element 18 will provide an airtight seal when paint remaining in the container 12 is to be stored. An engagement recess 41 may be provided in the lid 40 that engages the clamps 22. The lid 40 may be adapted to have a slightly different configuration than shown to fit securely on the edge projections of the rim element 18.

A handle 42 may be provided to help the user of the resealable airtight container system carry the system and attach it to a ladder or other structure. A handle 42 may be formed integrally with the rim element, as shown in FIGS. 2 and 3-5, or a handle 42 may be attached pivotally or in another convenient manner. The embodiment of the present invention shown in FIG. 7 has a pivotally attached handle. If desired, a carabiner or like device (not shown) may be attached to the handle to facilitate attachment of the system to a painter's work belt, a ladder, or to another other location.

FIG. 2 illustrates, diagrammatically, the resealable airtight container system 10 of the present invention from a side view turned 90 degrees from the front view in FIG. 1. In this view the relative locations of the clamp 22, pivot attachment location 24, and the recesses 28 in the edge cover 26 and 41 in the lid 40 can be seen. The integral attachment of the handle 42 to the rim element 18 may also be seen.

The rim element 18, the edge cover 26, and the lid 40 are shown in FIGS. 1 and 2 with spacing between these system components. When the container 12 is in use, and the edge cover 26 is clamped to the rim element 18 with the clamps 22 held within the engagement recesses 28, facing surfaces of these system components are in contact. To temporarily seal the system, the surface 36 of lid 40 will contact the edge cover 26. To seal the container with an airtight seal, the lid 40, as noted above, may be adapted to engage the edge projection 20 on the rim element 18, and the clamps 22 will engage the engagement recesses 41 in the lid 40.

Figure 3:
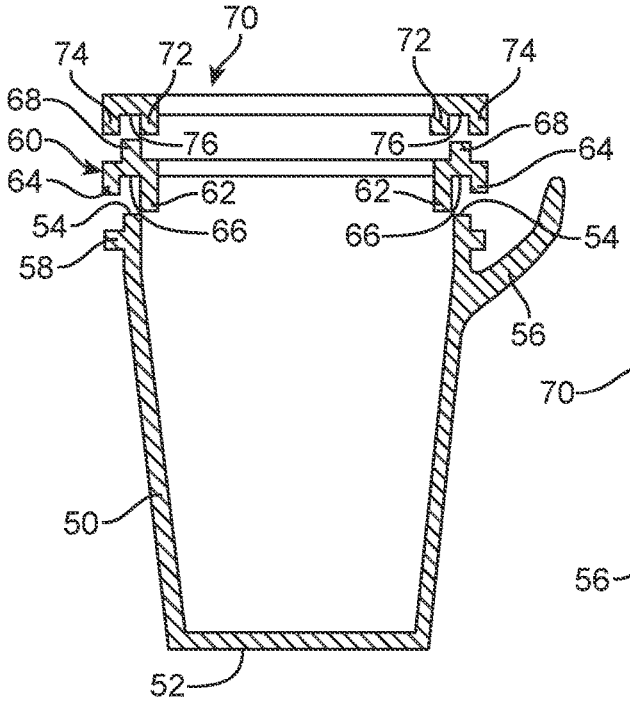
FIG. 3 is a side cross-sectional view of a second embodiment showing the components of this embodiment of the resealable airtight container system of the present invention.

A second embodiment of the resealable airtight container system of the present invention is shown in FIGS. 3-6. The container or paint holding portion of the system may have the shape of a trapezoidal solid, which is more clearly shown in FIGS. 4 and 5. FIG. 3 is a cross-sectional diagrammatic representation of the second embodiment of the system and shows the relationship of the system components designed to produce an airtight seal. A container 50, sized to hold a desired quantity of paint, may be formed with a bottom surface 52 having a smaller perimeter than the perimeter of a top edge 54 of the container 50. A handle 56 may be formed integrally with the container 50 or may be formed separately and attached to an exterior surface of the container 50. An exterior projecting rim 58 may be formed as an integral element of the container 50 to enhance sealing. A detachable lip 60 is a separate element and may be formed to fit securely onto the top edge 54 of the container 50 to cover the edge 54 of the container, preventing paint from reaching the edge 54. Spaced inner and outer attachment legs 62 and 64 extend from the lip 60 to receive the upper edge 54 of the container 50 within a receptacle 66 formed between the inner attachment leg 62 and the outer attachment leg 64. When the lip 60 is securely attached to the container 50, the outer leg 64 contacts the exterior projecting rim 58. A lip projection 68 may be formed opposite the receptacle 66 to extend outwardly of the lip 60 when it is in place on the container top edge 54. A container cover or lid 70 may have inner and outer sealing elements 72 and 74 that have the same spacing as the attachment legs 62 and 64 and that form a recess 76 with the same dimensions as the receptacle 66.

The detachable lip 60 functions as an edge protector that keeps the top edge 54 of the container 50 clean and free from paint when paint is mixed in the container, when excess paint is wiped from a brush, and in other situations that might cause paint to flow onto the top edge 54. If paint is to be stored in the container 50, the lip 60 may be removed, and the lid 70 secured in place on the top of the container with the top edge 54 held within the recess 76 between the lid inner and outer sealing elements 72 and 74. As noted above, the configurations of the attachment legs 62 and 64, the sealing elements 72 and 72 and the corresponding receptacle 66, and recess 76 should be selected to form a press fit or other secure connection that will hold the lip 60 in place on the container 50 during use and that will ensure the airtightness of the system when the lid 70 is attached to the container 50 to preserve paint for future use.

Figure 4:
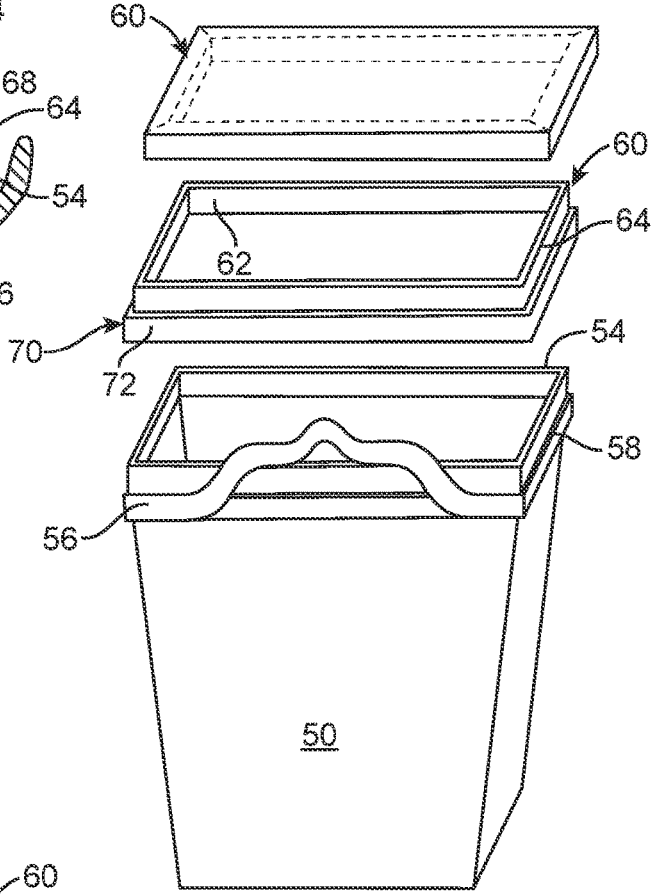
FIG. 4 is an exploded perspective view of the FIG. 3 embodiment of the resealable airtight container system of the present invention.

When the lip 60 is detached from the container, it may be cleaned and stored on top of the lid 70 so that it will be available for future use with the paint preserved in the container 50. The lid 70 may include a projecting rim 78 that may be inserted into the receptacle 66 to provide a temporary connection for storage of the lip 60. FIG. 4 illustrates an exploded perspective view of these components of the resealable airtight container system of the present invention. The container 50 is the bottom component shown, the lip 60 is the top component shown, and the lid 70 holding the lip 60 is the center component shown.

Figure 5:
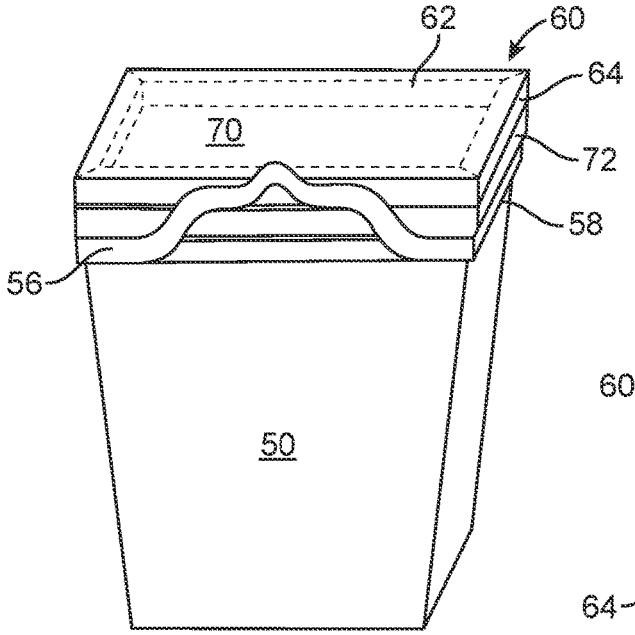
FIG. 5 illustrates the FIG. 3 embodiment of the resealable airtight container system of the present invention fully assembled.
Figure 6:
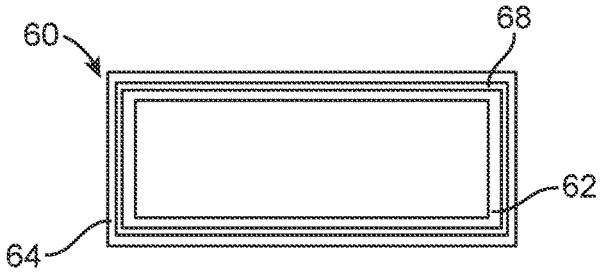
FIG. 6 is a top view of an edge or lip element usable with the resealable airtight container system of the present invention.

FIG. 5 illustrates a perspective view of the components of the second embodiment of the resealable airtight container system of the present invention as they would appear when the lip 60 has been removed and cleaned following a paint job and the lid 70 has been applied to the container 50 to preserve unused paint in the container. The lip 60 is shown in a stored position on the lid 70. FIG. 6 shows the lip 60 as it appears in top view and the peripheral location of the lip projection 68.

The trapezoidal solid shape of the container 50 is designed to increase the efficiency of a painter using the resealable airtight container system of the present invention during a paint job. The angled sides allow paint to drip back into the container without absorbing impurities from the container, as is the case with available paint buckets and containers. The lip 60 keeps the edge 54 of the container free from paint so that a secure airtight seal may be created when the lid 70 is placed on the edge 54 to seal the container 50. The shape of the container may easily accommodate several different types of brushes and a standard 6 inch paint roller, which eliminates the need for a separate roller tray for many painting jobs. As noted above, a carabiner, hook, or the like may be attached to the handle to permit the container system to be positioned in a range of different convenient locations for easy access by the user. In addition, resealable airtight container systems of the present invention may be easily stacked when not in use.

Figure 7:
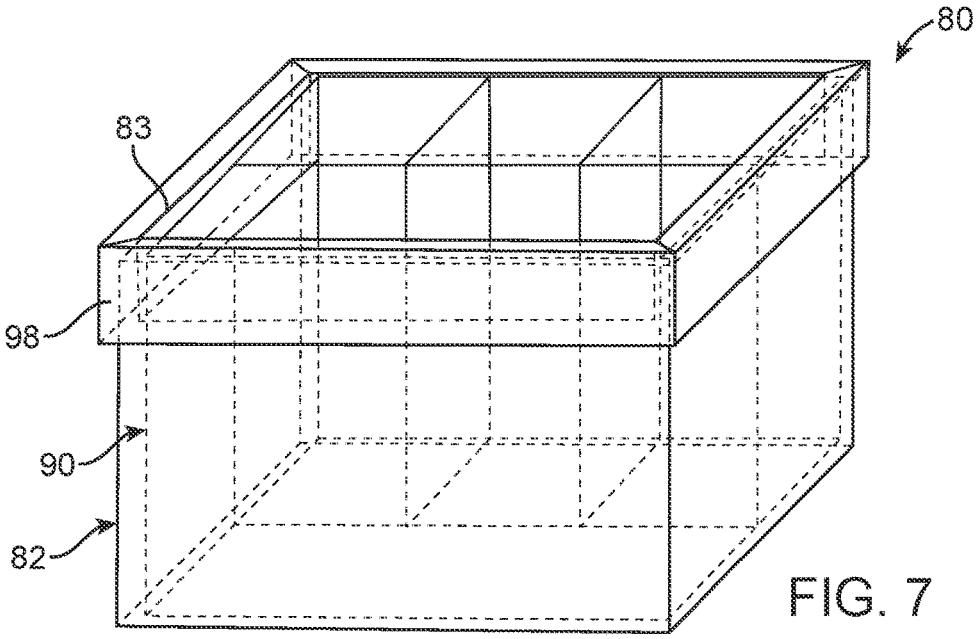
FIG. 7 shows a perspective view of a third embodiment of the resealable airtight container system of the present invention, which provides an integral painting tool carrier and paint holding and storage container.
Figure 8A:
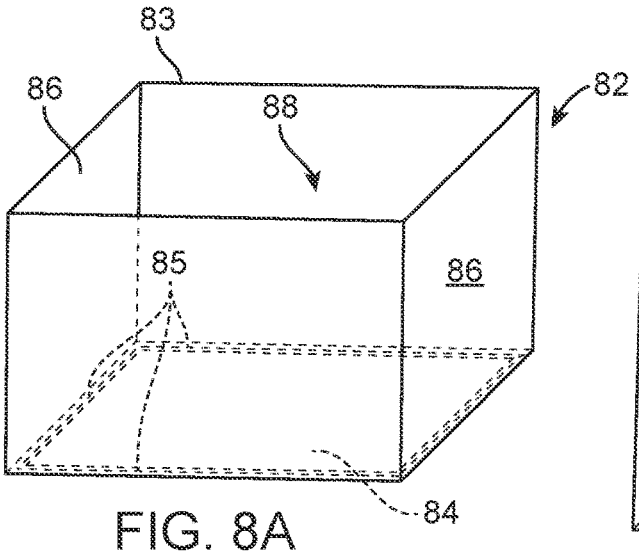
FIG. 8A shows a perspective view of an outer container section of the embodiment of the resealable airtight container system shown in FIG. 7.

A third embodiment of the resealable airtight container system of the present invention is shown in FIG. 7 and in FIGS. 8A-8D. This embodiment employs a similar lip element and lid member as the FIGS. 3-6 embodiment, but with a different container component. The assembled components of the resealable airtight container system of this embodiment are shown in FIG. 7. This resealable airtight container system 80 may have a rectangular box-like configuration and may be attached to wheels (not shown) for ease of movement and transport. It is designed to function both as a tool box that may hold a painter's tools and equipment and as a resealable airtight container system to store and preserve paint as described above. FIG. 8A shows the container outer component 82, which is a rectangular box with a solid bottom 84, solid sides 86, and an open top 88. A peripheral recess 85 may be provided in a surface-contacting bottom of the solid bottom 84. A removable insert 90 having the same rectangular box configuration as the outer container 82 with slightly smaller dimensions to enable it to fit within the outer container 82 may be formed with one or more compartments or sections sized to hold different painting tools, painting tools and paint, or different quantities or colors of paint.

Figure 8B:
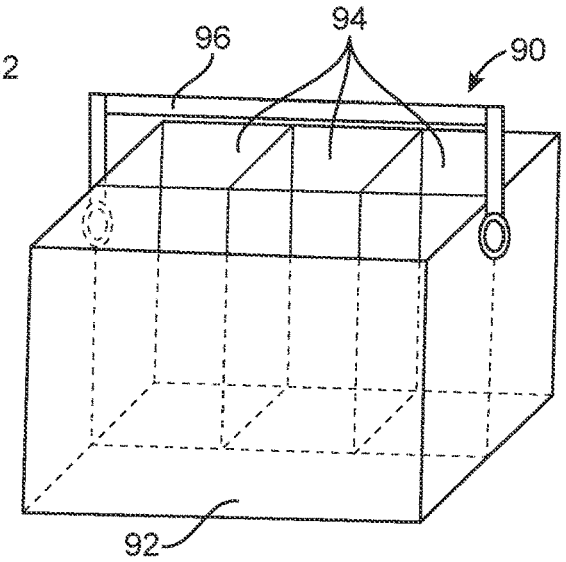
FIG. 8B shows a perspective view of an inner liner section of the embodiment of the resealable airtight container system shown in FIG. 7.
Figure 8C:
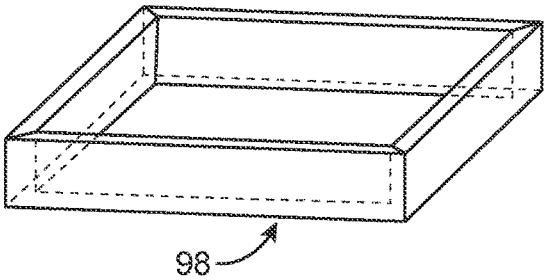
FIG. 8C shows a perspective view of a rim liner or lip element of the embodiment of the resealable airtight container system shown in FIG. 7.
Figure 8D:
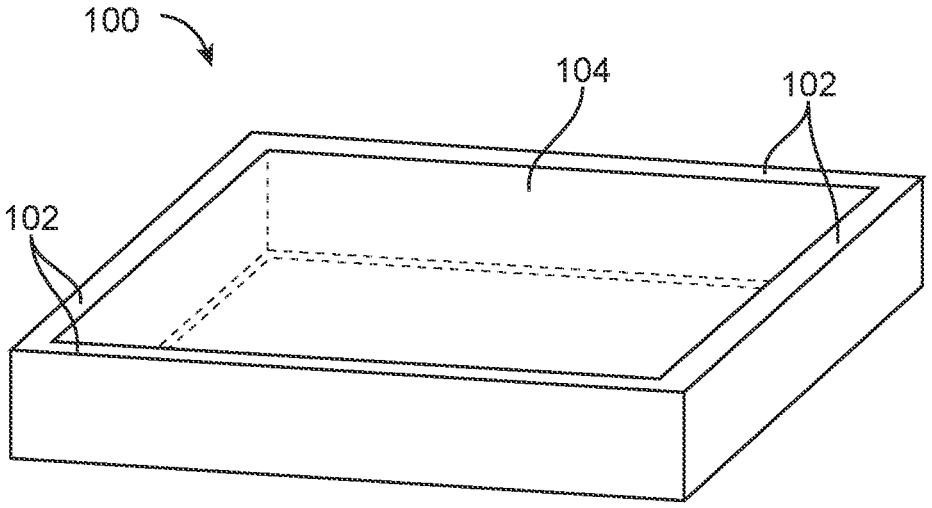
FIG. 8D shows a perspective view of a lid that may replace the rim liner or lip element of FIG. 8C of the embodiment of the resealable airtight container system shown in FIG. 7.

FIG. 8B illustrates an insert 90 with a single large section 92 that corresponds to about half of the insert 90 and three smaller sections 94 that correspond to the other half of the insert 90. Other combinations of different sized sections may also be provided for the insert 90. A handle 96 is shown pivotally attached to the insert 90, which permits easy removal of the insert with the painting tools from the container 82. When the insert 90 is removed from the container 82, the container may then be used to hold paint. For ease of cleaning, a flexible plastic liner of the type used by painters may be inserted into the container 82 before paint is added to the container. If the insert 90 is divided into multiple sections so that it may be used to hold different colors of paint, each section of the insert may be provided with a flexible liner to facilitate cleaning.

A lip element 98 (FIG. 8C), which has a structure similar to that of lip 60 in the second embodiment of the resealable airtight container system, may be secured to the upper edge 83 of the open top 88 of the container 82 over the one or more flexible liners (not shown). The lip element 98 keeps the upper edge 83 of the container 82 clean and free from paint during use of the container to hold paint. The lip element 98 may be removed and replaced by a lid 100, shown in FIG. 8D, that has a structure similar to that of the embodiment shown in FIGS. 3-6 to provide an airtight seal for the container to preserve any paint to be stored for future use in a clean high quality condition. The peripheral recess 85 in the lower surface of the container component 82 may be configured to engage a peripheral projection 102 on a non-sealing surface 104 of the lid 100. Two or more of the container systems 80 may be stacked so that the peripheral projection 102 on the lid of one rectangular container 82 engages the peripheral recess 85 in the bottom lower surface of another rectangular container 82 stacked on top. When the container 82 is no longer needed to hold or store paint, it may be cleaned and the insert 90 inserted to hold painting tools so that the system may function as a tool box. Multiple ones of this embodiment of the resealable airtight container system of the present invention may be loaded with painting tools and paint and stacked together to provide all of the equipment and paint needed for a job. As noted above, wheels may be provided, such as on a bottom container, to make it easier for a painter to move the stacked containers. An arrangement of three resealable airtight containers according to the present invention stacked and moved, for example by a wheeled hand truck, may be fitted with disposable liners to provide multiple containers for paint and may also carry all of the painting tools needed for a job. A shoulder strap may be provided for a single resealable airtight container of the present invention with a divided insert 90 as discussed above in connection with FIGS. 7 and 8A-8C to hold both paint and painting tools in the same container, leaving the painter with one or both hands free.

Professional painters often do not use five gallon buckets of paint, which may be more cost effective than using multiple single gallons, but may also produce more wasted paint if all of the paint is not used and the five gallon buckets cannot be resealed securely, as described above. The resealable airtight container of the present invention may be sized to hold these large quantities of paint and then may be securely resealed to preserve the paint for a longer time than may be possible at the present time, including over a weekend. In addition, larger paint rollers, for example 18 inch rollers, and larger brushes that will fit easily in such containers may be used to cover more surface area with paint in a shorter time than the 9 inch rollers and smaller brushes typically used by many professional painters and most do-it-yourself painters.

It is contemplated that the container and lid components of the resealable airtight container system of the present invention may be made of a durable rigid plastic that will not react chemically with the paint or similar liquids to be stored in the sealed container. The lip component may be made of a silicone material. Other suitable materials may also be used to form the components of the resealable airtight container system of the present invention.

While the present invention has been described primarily as a resealable airtight container system useful for holding paints and for use by painters, the system of the present invention may also be used to hold, store, and preserve liquids with properties similar to those of paint.

While the present invention has been described with respect to preferred embodiments, this is not intended to be limiting, and other arrangements and structures that perform the required functions are contemplated to be within the scope of the present invention.

INDUSTRIAL APPLICABILITY

The present invention will find its primary applicability when it is desired to provide a versatile container system useful for holding paint and similar liquids during their application and for preserving unused paint in a clean high quality condition for future application.

The invention claimed is:

1. A resealable airtight container system for holding, using, and storing paint that preserves and maintains the paint in a clean, high quality condition during use and storage, comprising:

a. a non-cylindrical container with a configuration designed to hold a quantity of paint, comprising a surface-contacting bottom, an opening opposite said surface-contacting bottom, and walls extending between said surface-contacting bottom and said opening to form an edge around said opening to hold said quantity of paint;

b. a lip element having a shape corresponding to a shape defined by said edge and to removably attachable to said edge to form a protective cover keeping said edge paint-free when said lip element is attached to said edge, said lip element further being removably attachable to a lid member when removed from attachment to said edge;

c. said lid member having a shape corresponding to said shape defined by said edge comprising a sealing portion and a storage portion, said lid member sealing portion being removably attachable to said lip element to cover said lip element when said lip element is attached to said edge, said lid member sealing portion forming an airtight seal covering said edge when said lip element is removed from attachment to said edge, and said lip element being removably attachable to said storage portion; and d. attachment and sealing means for removably attaching said lip element to said edge and to said lid member storage portion, for removably attaching said lid member sealing portion to said lip element, and for forming said airtight seal between said lid member sealing portion and said edge of said non-cylindrical container, wherein said attachment and sealing means comprises a stop element disposed about an exterior perimeter or circumference to project outwardly of said non-cylindrical container, said lip element comprises inner and outer attachment legs spaced about a periphery of an edge-contacting surface to receive said edge and engage said stop element when said lip element is removably attached to said edge, and a sealing projection extending about a periphery of a surface opposite said edge-contacting surface, and said lid member comprises a sealing groove between projecting legs in a said sealing portion with attachment legs spaced about said sealing groove to engage said lip element sealing projection when said lid member is removably attached to said lip element and to receive said edge with a lid member attachment leg engaging said stop element when said lip element is removed from attachment to said edge.

2. The system of claim 1, wherein said non-cylindrical container has a rectangular box configuration and has a separate sectioned removable rectangular insert member sized to fit within the rectangular box, said surface-contacting bottom comprises a peripheral recess, and said lid member further comprises a peripheral projection in said storage portion to engage said surface-contacting bottom peripheral recess when two or more of said non-cylindrical containers are stacked with said surface-contacting bottoms in contact with said lid member storage surfaces.

3. A resealable airtight container system for holding and storing paint that preserves and maintains the paint in a clean, high quality condition during use and storage, comprising:

a. a non-cylindrical container comprising a surface-contacting bottom, an opening opposite said surface-contacting bottom, and walls extending between said surface-contacting bottom and said opening to form an edge around said opening;

b. a lip element configured to correspond to a shape defined by said edge and to cover said edge when said lip element is removably attached to said non-cylindrical container;

c. a lid member configured to removably cover said lip element when said lip element is attached to said non-cylindrical container to cover said edge and to provide an airtight seal covering said edge when said lip element is removed from attachment to said non-cylindrical container and said lid member is attached directly to said edge, wherein said lid member comprises a peripheral projection on an outer surface opposite said edge configured to engage said lip element inner and outer attachment legs to attach and store said lip element when said lip element is removed from attachment to said edge and said lid member is attached to said edge; and d. attachment and sealing means for securing said lip element to said edge, said lid member to said lip element, and for securing and sealing said lid member to said edge of said non-cylindrical container with an airtight seal, wherein said attachment and sealing means comprise a stop element disposed about an exterior perimeter or circumference of said non-cylindrical container, inner and outer attachment legs spaced about a periphery of an edge-contacting surface of said lip element to engage said edge and said stop element, and a sealing projection extending about a periphery of an opposite surface of said lip element to engage a sealing groove in a sealing surface of said lid member.

4. The system of claim 3, wherein said non-cylindrical container further comprises a handle integrally formed with said container walls or separately formed and attached to said container walls.

5. The system of claim 3, wherein said non-cylindrical container has the shape of a trapezoidal solid with said edge having a larger perimeter dimension than the perimeter dimension of said surface-contacting bottom, and said lip element and said lid member have a rectangular shape.

6. The system of claim 3, wherein said non-cylindrical container has the shape of a truncated cone with said edge having a larger circumferential dimension than the circumferential dimension of said surface-contacting bottom and said walls comprise an angled interior surface between said edge and said surface-contacting bottom to receive excess paint from a paint brush.

7. The system of claim 3, wherein said non-cylindrical container has the shape of a rectangular box and said system further comprises a separate sectioned removable rectangular insert member sized to fit within said rectangular box, wherein said lip element and said lid member have a rectangular shape and are sized to cover said edge when said insert member is positioned within said rectangular box and when said insert member is removed from said rectangular box.

8. The system of claim 7, wherein said sectioned removable insert comprises one or more sections sized to hold paint and sized to hold painting tools and a handle pivotally attached to said sectioned removable insert.

9. The system of claim 7, wherein said surface-contacting bottom of said rectangular box comprises a peripheral recess configured to engage a peripheral projection on a non-sealing surface of said lid member, and two or more of said rectangular boxes are stacked so that said peripheral projection on said lid member non-sealing surface of one rectangular box engages said peripheral recess on said surface-contacting bottom of another rectangular box stacked on said one rectangular box.

10. The system of claim 9, further comprising a stack of more than two of said rectangular boxes with a surface-contacting bottom of said stack of more than two rectangular boxes being stacked on a movable wheeled hand truck.

11. The system of claim 3, further comprising a rim element attached to said non-cylindrical container edge, and said attachment and sealing means further comprises at least a pair of clamps spaced about a periphery of said rim element pivotable into and out of engagement with said lip element or said lid member.

12. The system of claim 3, wherein said attachment and sealing means secure said lip element to said edge, said lid member to said lip element, and said lid member to said edge by a press fit.

13. A method for holding, storing, and preserving paint for reuse, comprising:

a. providing a resealable airtight container system comprising a non-cylindrical container with a lip element removably attached to an open edge of said non-cylindrical container to cover the edge, a lid member configured to cover the lip element when the lip element is attached to the non-cylindrical container and to cover the edge when the lip element is removed from attachment to the non-cylindrical container, the lip element and the lid member being formed with attachment and sealing structures to form a secure and airtight seal when the lip element and the lid member are attached to the edge of the non-cylindrical container;

b. adding a quantity of paint to the non-cylindrical container;

c. attaching the lip element to the edge with the attachment and sealing structures;

d. removing a portion of the quantity of paint from the non-cylindrical container with a paint applicator in a manner that causes excess paint to flow back into the container or on the lip element;

e. when no more of the quantity of paint is to be removed from the non-cylindrical container, detaching the lip element from the edge and attaching and securing the lid member with the attachment and sealing structures to the edge to provide an airtight seal for the non-cylindrical container holding unused paint for storage and preservation; and f. cleaning the lip element and securing the cleaned lip element to an outward surface of the lid member with the attachment and sealing structures.

14. The method of claim 13, wherein the non-cylindrical container has the shape of a rectangular box and has a separate sectioned removable rectangular insert member sized to fit within the rectangular box and comprising one or more sections sized to hold paint and painting tools, the lip element has a rectangular shape sized to cover the edge, and the lid member has a rectangular shape sized to cover the edge and the lip element, further comprising inserting paint or painting tools into the one or more sections of the insert member, inserting the insert member with the paint or tools into the rectangular box, and attaching the lid member and the lid element to the edge of the rectangular box.

15. The method of claim 14, further comprising:

a. providing a flexible liner and painting tools in the insert member sections, removing the insert member from the rectangular box, lining the rectangular box with the flexible liner, covering the rectangular box edge and the flexible liner with the lip element, and adding the quantity of paint to the lined rectangular box; and b. when no more of the quantity of paint is to be removed, detaching the lip element, removing the flexible liner, inserting the insert member and painting tools, attaching the lid member to the rectangular box edge, and securing the lip element to the lid member.

16. The method of claim 14, further comprising providing a peripheral recess on a surface-contacting bottom of the rectangular box configured to engage a peripheral projection on the outward surface of the lid member, stacking a first rectangular box with the surface-contacting bottom on a wheeled hand truck and stacking others of the rectangular boxes with the peripheral projection on the lid member of the first rectangular box engaging the peripheral recess of the surface-contacting bottom of an upper rectangular box, and moving the stack of rectangular boxes with the wheeled hand truck.

* * * * *